United States Patent [19]

Meier

[11] Patent Number: 4,607,585

[45] Date of Patent: Aug. 26, 1986

[54] SEWING MACHINE HAVING A PROGRAM CARRIER

[75] Inventor: Günter Meier, Karlsruhe-Durlach, Fed. Rep. of Germany

[73] Assignee: Dorina Nähmaschinen GmbH, Fed. Rep. of Germany

[21] Appl. No.: 532,829

[22] Filed: Sep. 16, 1983

[30] Foreign Application Priority Data

Sep. 22, 1982 [DE] Fed. Rep. of Germany ..... 3235078

[51] Int. Cl.[4] ..... D05B 3/02

[52] U.S. Cl. ..... 112/454; 112/451; 112/266.1

[58] Field of Search ..... 112/158 E, 121.11, 262.1, 112/121.12, 266.1, 275, 277, 454, 457, 458, 453, 451, 317

[56] References Cited

U.S. PATENT DOCUMENTS

| | | | |
|---|---|---|---|
| 4,275,674 | 6/1981 | Carbonato | 112/158 E |
| 4,326,473 | 4/1982 | Kigawa | 112/158 E |
| 4,334,486 | 6/1982 | Toshiaki et al. | 112/158 E |
| 4,409,915 | 10/1983 | Eguchi et al. | 112/158 E X |
| 4,413,574 | 11/1983 | Hirota et al. | 112/158 E X |

*Primary Examiner*—Peter Nerbun

*Attorney, Agent, or Firm*—McGlew and Tuttle

[57] ABSTRACT

To produce novel pattern designs differing from patterns which are available, a sewing machine comprising control segments stored in a pattern carrier and corresponding each to one sewing pattern formed by a group of stitches, a device for sensing the program carrier, and a device for controlling the needle and feed movements determining the pattern, is provided with a second program carrier including control segments for at least a single stitch, with the second program carrier being activatable through a selector switch between two consecutive steps of sensing one or more of the control segments of the first program carrier. In an electronically controlled sewing machine capable of storing in a programmable working storage any number of sewing patterns which can be sequentially recalled, a program carrier comprises at least one control segment which is associated with a single stitch and whose starting address can be stored in the working storage once or several times between addresses of control segments of the sewing patterns. If the additional control segment corresponds to a single backward stitch, a particularly great number of designs completely differing from the basic pattern can be produced.

5 Claims, 18 Drawing Figures

Fig. 3
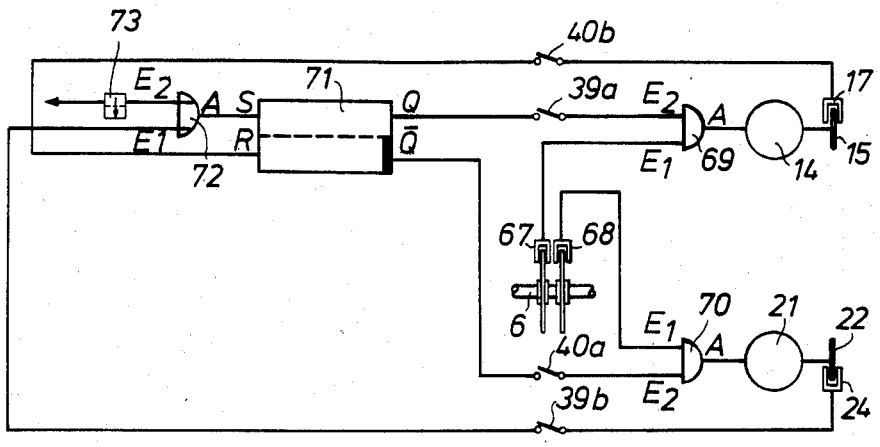
Fig. 4
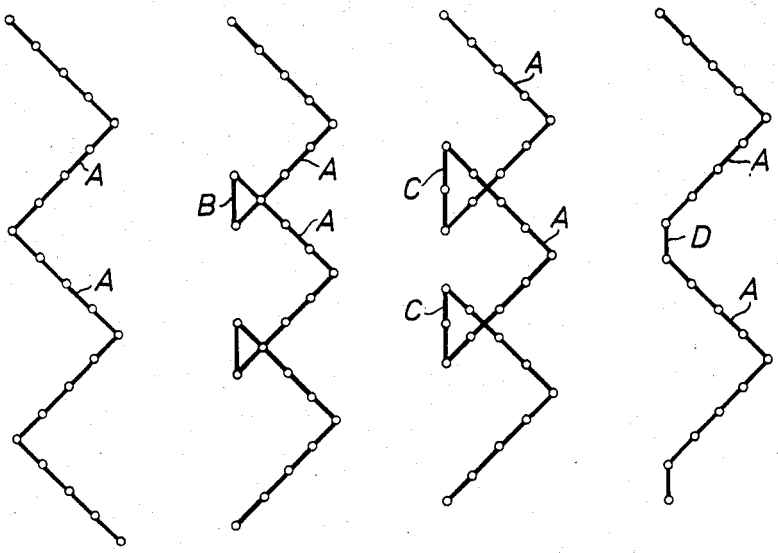
Fig. 4a Fig. 4b Fig. 4c Fig. 4d

| PIERCING POINT | FEED POSITION | NEEDLE POSITION |
|---|---|---|
| 0 | 0 | 36 |
| 1 | + 6 | 24 |
| 2 | + 6 | 12 |
| 3 | + 6 | 0 |
| 4 | + 6 | 12 |
| 5 | + 6 | 24 |
| 6 | + 6 | 36 |

| PIERCING POINT | FEED POSITION | NEEDLE POSITION |
|---|---|---|
| 0 | 0 | 36 |
| 1 | + 6 | 24 |
| 2 | + 6 | 12 |
| 3 | + 6 | 0 |
| 4 | + 6 | 12 |
| 5 | + 6 | 24 |
| 6 | + 6 | 36 |
| R 0 | 0 | 36 |
| R 1 | −15 | 36 |

| PIERCING POINT | FEED POSITION | NEEDLE POSITION |
|---|---|---|
| 0 | 0 | 36 |
| 1 | + 6 | 24 |
| 2 | + 6 | 12 |
| 3 | + 6 | 0 |
| 4 | + 6 | 12 |
| 5 | + 6 | 24 |
| 6 | + 6 | 36 |
| R0 | 0 | 18 |
| R1 | −15 | 18 |

| PIERCING POINT | FEED POSITION | NEEDLE POSITION |
|---|---|---|
| 0 | 0 | 36 |
| 1 | +6 | 24 |
| 2 | +6 | 12 |
| 3 | +6 | 0 |
| 4 | +6 | 12 |
| 5 | +6 | 24 |
| 6 | +6 | 36 |
| R0 | 0 | 0 |
| R1 | -15 | 0 |

L
M
R
18/0
1
2
3
4
5
6
7
8
MR40
9
11
12
13
14
15
16
17
18/0

L
M
R
R1/0
MR03
18/R0

L
M
R
R2/0
R1
18/R0

L
M
R
R3/0
R2
R1
18/R0

SEWING MACHINE HAVING A PROGRAM CARRIER

FIELD AND BACKGROUND OF THE INVENTION

This invention relates in general to the construction of sewing machines and in particular to a new and useful sewing machine having a program carrier.

Prior art sewing machines of this kind make it possible to produce sewn pattern sequences by repeating a single sewing pattern. It is also provided to vary the pattern. Or, a pattern sequence may be formed of a plurality of different sewing patterns. Many pattern sequences of various configuration may thus be produced, however, they all are similar in form and substantially correspond to the sewing patterns stored in the program carrier.

SUMMARY OF THE INVENTION

The invention is directed to an arrangement permitting the single production from available sewing patterns, of a plurality of new pattern structures which differ from the available patterns in their configuration.

In accordance with the invention the sewing machine is provided which includes control segments or separately actuated movement controllers which are stored in the program carrier. Each of the segments or movement controllers corresponds to a sewing pattern formed of a group of stitches. The sewing machine includes a rotatable drive shaft which drives a needle for vertical upward and downward movement and wherein the needle is mounted in a swing arm which is connected to the shaft for selected pivotal swing movement during the needle's upward and downward movement. The feed dog is movable selectively upwardly and downwardly and backwardly and forwardly in the feed direction and returned so as to engage and move the workpiece material during the reciprocation of the needle. With the invention, a sewing machine is equipped with a stepping motor for swinging a needle at a preselected rate and amplitude and another stepping motor is provided for controlling the movement of the feed dog so as to effect the desired stitch patterns. The construction includes a selector in the form of a feed button or controller which engages one of the separately actuated movement controller and places it in the drive of the associated stepping motor for the swinging of the needle and also for the movement of the workpiece.

The invention makes it possible to produce from a certain sewing pattern in a simple way pattern configurations having a completely different aspect, whereby the utility of the sewing machine is considerably increased.

The sewing machine of the invention may be entirely electronically controlled in which case a program carrier is formed by a fixed storage (ROM). The ROM may comprise a plurality of control segments each having a selected sewing pattern and containing control data. The device advantageously includes a programmable working storage (RAM) in which by actuating a program entering key the starting addresses of a number of this plurality of different control segments can consecutively be stored. The construction includes a microcomputer for sequentially recalling the control segments associated with the starting addresses and a device for controlling the stitch forming elements of the sewing machine in conformity with the control data readout of the control segments. The program carrier advantageously contains at least one control segment which is associated with a single stitch and whose starting address can be stored in a working storage. the program entering key can be actuated one or more times between two consecutive starting addresses of sewing pattern control segments. The program carrier may advantageously comprise at least one control segment corresponding to a single backward stitch. With such a feature a particularly large variation of available patterns is achieved. This is because by shifting over one another consecutive individual sewing patterns, the configuration can be varied substantially.

Accordingly, it is an object of the invention to provide an improved sewing machine having means for controlling selectively both the swinging movement of the swing needle and the movement of the feed mechanism for the workpiece in accordance with the actuation of one of a plurality of selectable segment element elements or movement control devices.

A further object of the invention is to provide a sewing machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 3 is a circuit diagram of the program carrier control;

FIGS. 4*a* to 4*d* show variations of a pattern sequence obtained by alternatively actuating the program carrier drives;

GENERAL DESCRIPTION OF THE PREFERRED EMBODIMENTS

Figure 1:
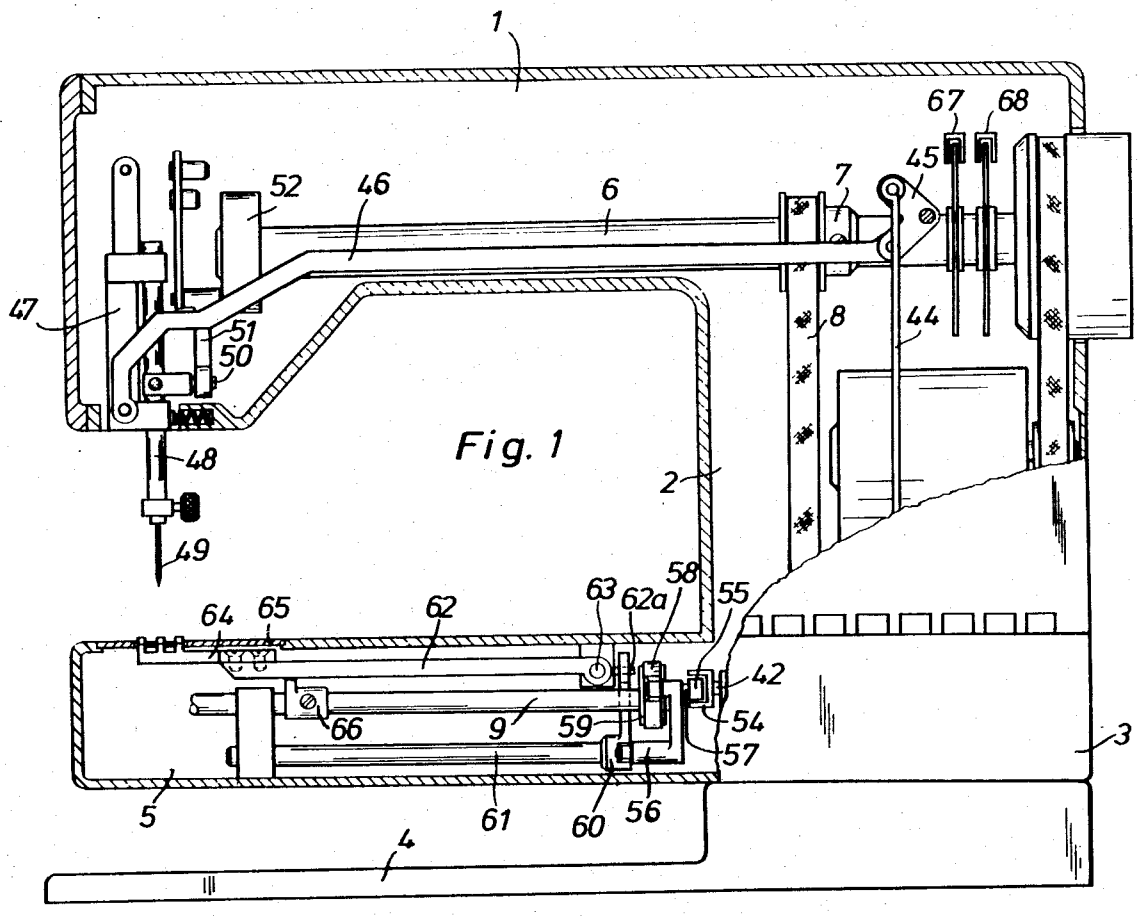
FIG. 1 is an elevational view of a first embodiment of a sewing machine equipped with control drives for the stitch position and feed.
Figure 2:
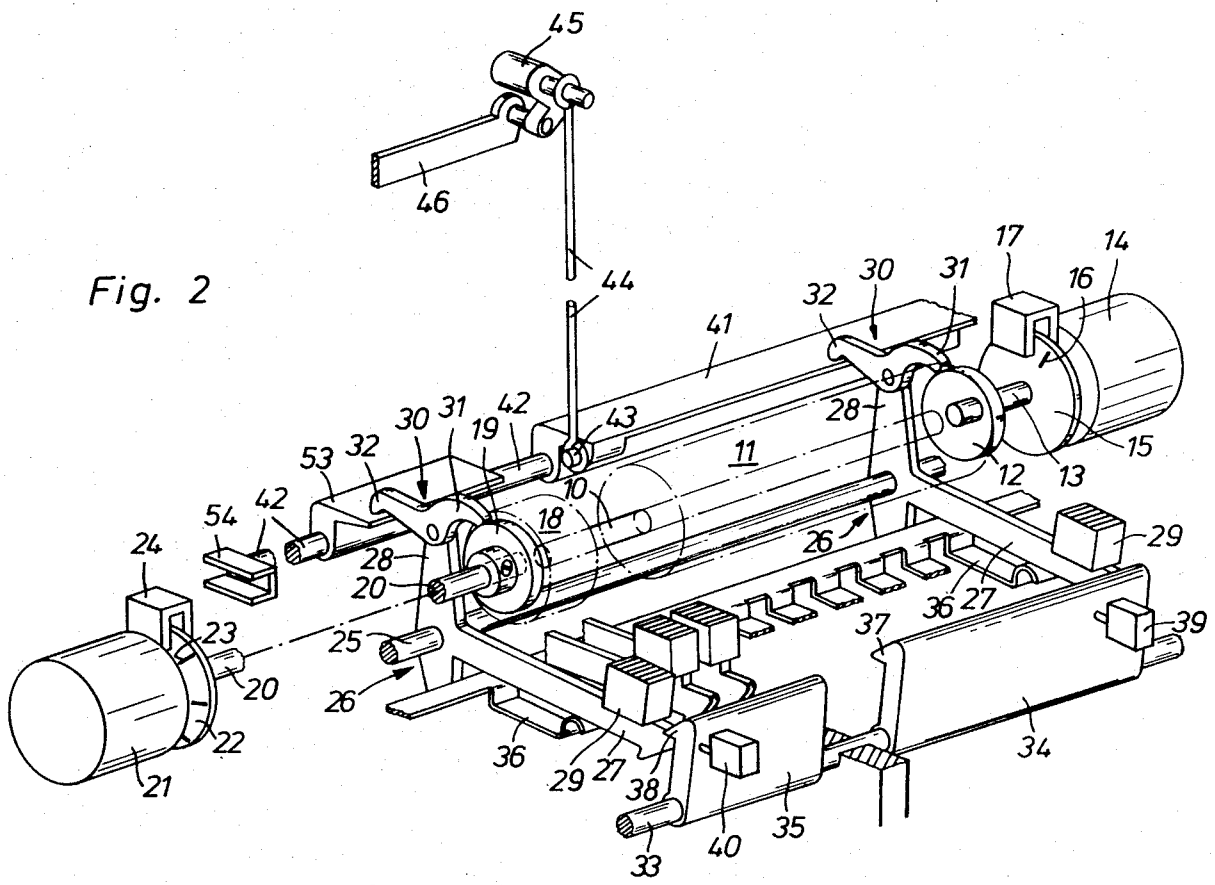
FIG. 2 is a perspective view of the selection and drive mechanisms associated with the program carriers.

Referring to the drawings in particular the invention embodied therein in FIGS. 1 to 4, comprises a sewing machine which includes a rotatable drive shaft 6 driving a needle 49 for vertical upward and downward movement and a swing arm 47 which is connected to the shaft so as to be driven at selected pivotal swing movements through selected bight distances during its vertical reciprocation. The construction includes a feed dog 64 which is movable selectedly upwardly and downwardly and backwardly and forwardly in the feed direction or in a return direction to engage and move the workpiece material.

In accordance with the invention, the needle swing control motor 14 is provided for controlling the swinging movement of the needle 49 and a workpiece feed motor 21 is provided for controlling the feed of the workpiece feed dog 64. A program carrier is provided for programming a swinging movement and a separate program carrier is provided for programming the feed movement of the feed dog 64 and they are designated 11 and 18 respectively in FIG. 2. Each comprises a plurality of control elements or movement controllers such as the control segment 12 for the program carrier 11 and the control segment 19 for the program carrier 18.

The sewing machine shown in FIG. 1 comprises an arm 1 which is connected through a post 2 to a base 3. Base 3 is supported by a bottom plate 4 and is enlarged toward its front side relative to the post 2 and the arm 1. Base 3 comprises a fabric supporting arm 5 which is offset rearwardly relative to the central axis of base 3 and accommodates the lower stitch forming tools, particularly the loop forming hook of the sewing machine.

A main shaft 6 mounted in arm 1 of the sewing machine drives through a gear 7 and a cog or gear belt 8, a lower shaft 9 which, in a manner known per se (not shown), serves the purpose of driving the loop forming hook of the machine.

A shaft 10 is rotatably supported within base 3 and it carries a program carrier 11 which is loosely supported thereon. The program carrier comprises a plurality of control segments 12 placed side by side and designed as cam discs. Program carrier 11 is connected to the shaft 13 of a stepping motor 14. Secured to shaft 13 is a pulse disc 15 carrying a pulse mark 16 which indicate a definite angular position of program carrier 11 and cooperate with a pulse generator 17.

Shaft 10 further loosely supports another or second program carrier 18 which also comprises control segments 19 designed as cam discs. Program carrier 18 is connected to the shaft 20 of a second stepping motor 21. Secured to shaft 20 is a pulse disc 22 carrying pulse marks 23 which indicate definite angular positions of program carrier 18 and cooperate with a pulse generator 24. Each control segment 19 in program carrier 18 contains information for controlling individual forward or backward stitches.

To another shaft 25 mounted in base 3, a plurality of levers 26 is hinged corresponding in number to the number of control segments 12 and 19. Each lever 26 comprises a lock arm 27 and an upwardly projecting arm 28. On each of arms 27, a key button 29 is engaged which protrudes through a corresponding aperture above the surface of base 3. Hinged to each lever 26 is a contact lever 30 which is provided with two tracer noses 31 and 32.

Levers 26 are pivotable into two positions by means of two stop rockers 34 and 35 which are mounted within base 3 on a shaft 33. In a normal position, levers 26 loaded from below by springs 36 apply against the respective associated stop rocker 34 or 35. Their lock arm 27 is engageable from below with a respective projecting shoulder 37, 38 of rockers 34, 35 which are urged by springs into contact with fixed stops provided in the housing (not shown). Stop rockers 34, 35 cooperate with microswitches 39, 49. Upon engaging a lever 26 below projecting shoulder 37 of rocker 34, the contacts of microswitch 39 close, and similarly close the contacts of microswitch 40 if a lever 26 is engaged with shoulder 38 of rocker 35. With levers 26 disengaged, the contacts of microswitches 39, 40 are open.

Tracer noses 31 provided at one side of contact levers 30 associated with program carrier 11, are intended to cooperate with one at a time of the juxtaposed control segments 12, while tracer noses 32 provided at the other side of levers 13 apply against the rocker frame 41 which is pivotable on a shaft 42 mounted in base 3. Rocker frame 41 carries a pin 43 which is attached through a connecting rod 44, a crank 45 pivoted to arm 1, and another connecting rod 46 (FIG. 1) to a swing arm 47 of the needle bar. A swing arm 47 is pivoted in arm 1 and carries a vertically movable needle bar 48 supporting the needle 49. Needle bar 48 carries a fixed pin 50 engaging a link 51 which is hinged to a crank 52 secured to main shaft 6.

Tracer noses 32 (FIG. 2) of those contact levers 30 which cooperate with control segments 19 apply against a rocker frame 53 which is rigidly secured to shaft 42. Further secured to shaft 42 is a guide member 54 providing a guideaway for a sliding block 55 (FIG. 1). Sliding block 55 is secured to a pin 57 which is supported by a link 56. Pin 57 is connected to an eccentric rod 58 embracing an eccentric 59 which is mounted on shaft 9.

Link 56 is connected to one arm of an angle lever 60 which is secured to a shaft 61 mounted in fabric supporting arm 5. Another, upwardly projecting arm of angle lever 60 is provided on its end with a guide slot in which a pin **62*a* of a supporting arm 62 is guided. Supporting arm 62 is mounted for displacement on a horizontal shaft 63 which extends in fabric supporting arm 5 parallel to the feed direction. On its free end, arm 62 supports a feed dog 64 whose teeth protrude through slots in needle plate 65 to engage the work. Supporting arm 62 bears against a lifting eccentric 66 which is secured to shaft 9**.

Main shaft 6 cooperates with pulse generators 67, 68. As the main shaft 6 rotates, and at every revolution of the shaft, pulse generator 67 delivers a pulse everytime needle 49 has emerged from the work, while pulse generator 68 delivers a pulse everytime the feed dog 64 has terminated its feed motion.

Stepping motor 14 (FIG. 3) is connected to the output A of an AND gate 69, and stepping motor 21 is connected to the output A of an AND gate 70. Each of AND gates 69 and 70 has inputs E1 and E2. Input E1 of AND gate 69 is connected to pulse generator 67 which is controlled by arm shaft 6 of the sewing machine, while input E1 of AND gate 70 is connected to pulse generator 68 which also is controlled by shaft 6.

Through contact **39*a*, which is closed in a switched-on state of microswitch 39, input E2 of AND gate 69 is connected to the output Q of a flip-flop gate 71, while input E2 of AND gate 70 is connected in a similar way through contact 40*a* of microswitch 40 to the output $\overline{Q}$ of flip-flop gate 71**.

Flip-flop gate 71 is connected by its resetting input R through contact **40*b*, which is closed in a switched on state of microswitch 40, to pulse generator 17, and by its setting input S to the output A of an OR gate 72. Input E1 of OR gate 72 is connected through contact 39*b*, which is closed in switched-on state of microswitch 39, to pulse generator 24, and input E2 is connected through a short-time stage 73** to the main switch of the sewing machine.

Upon switching on the sewing machine, L potential is applied through short-time stage 73, which is coupled to the main switch (not shown), to input E2 of OR gate 72, so that flip flop 71 is set, through its setting input S. The L potential is thus also applied to output Q of flip-flop 71. During the sewing operation, after every stitch, a pulse is delivered by pulse generator 67 to input E1 of AND gate 69, and by pulse generator 68 to input E1 of AND gate 70. However, both AND gates 69 and 70 are disabled since levers 26 are not engaged and contacts 39*a*, 40*a* of microswitchs 39, 40 are open.

The bight width of needle bar swing arm 47 (FIG. 1 and 2) is controlled by actuating one of key buttons 29 associated with program carrier 11. Upon pressing a key button 29, the respective lever 26 is pivoted downwardly and its lock arm 27 engages from below shoulder 37 of stop rocker 34. During this locking movement, another lever 26 which might have been locked to shoulder 37 earlier, is pushed upwardly by its spring 36 and applies then from above freely on stop rocker 34.

By moving lever 26 into its lower position, contact lever 30 hinged thereto is brought into contact with the respective control segment 12 and with a rocker frame 41. At the same time, microswitch 39 is actuated i.e. contacts 39*a* and 39*b* are closed (FIG. 3). Thereby, L potential of output Q of flip-flop gate 71 is applied through closed contact 39*a* to input E2 of AND gate 69. Gate 69 now allows the stepping pulses pass through its input E1, so that stepping motor 14 is driven and the machine produces the desired pattern corresponding to the design of control segment 12.

While driving program carrier 11 through stepping motor 14 (FIGS. 1 and 2), rocker frame 41 is pivoted through respective lever 30 by a selected control disc 12, so that swing arm 47 of the needle bar is correspondingly pivoted through connecting rod 44, crank 45, and connecting rod 46. Needle 49 is thereby brought laterally into its position for the next stitch.

At the end of the sewing pattern including, for example, nine stitches, i.e. after one revolution of program carrier 11, pulse generator 17 (FIG. 3) delivers a pulse through contact 40*b* of microswitch 40 to input R of flip-flop gate 71. If now, none of the key buttons 29 associated with program carrier 18 is pressed down, contact 40*b* of microswitch 40 is open and the delivery of pulses to resetting input R of the flip-flop gate is interrupted. The stepping pulses from pulse generator 67 continue to drive stepping motor 14 and the sewing pattern is sequentially repeatedly sewed, up to the end of the sewing operation.

By actuating one of key patterns 29 associated with program carrier 18 (FIG. 2), the contact lever 30 hinged to the respective lever 26 moves into contact with the corresponding control segment 19 and the rocker frame 53. At the same time, microswitch 40 is closed. Lever 26 is locked in the above described manner.

Then, if after the next revolution of program carrier 11, pulse generator 17 delivers a pulse through the now closed contact 40*b* (FIG. 3) of microswitch 40, to the resetting input R of flip-flop gate 71, the gate switches over. L potential is now applied to output Q of flip-flop gate 71, thus also to input E2 of AND gate 69, so that AND gate 69 no longer allows stepping pulses to pass therethrough, and stepping motor 14 interrupts further indexing of program carrier 18.

At the same time, output $\overline{Q}$ of flip-flop gate 71 switches to H potential which is thus applied through closed contact 40*a* of microswitch 40 to output E2 of AND gate 70, so that this gate now allows passage to the stepping pulses of pulse generator 68. These pulses are delivered to stepping motor 71 (FIGS. 1 and 2) by which program carrier 18 is driven, up to the response of pulse generator 24.

As program carrier 18 is driven by stepping motor 21, rocker frame 53 is pivoted by the selected control segment 19 through the respective contact lever 30, and in turn, through shaft 52, causes pivoting of guide member 54 in accordance with the cam shape of segment 19. The pivoting of bolt 57 thereby effected causes a displacement of sliding block 55 is guideway 54, through eccentric rod 58. In accordance with the angular position of guide member 54, angle lever 60 is pivoted by sliding block 55 through link 56. Lever 60 displaces supporting arm 62 on shaft 63 back and forth, thereby imparting on its free end feed movements to feed dog 64, the extent of which depends on the shape of the cam of the selected control segment 19.

The lifting motion of feed dog 64 takes place in accordance with the horizontal shifting motion thereof and is effected by lifting eccentric 66 which is secured to shaft 5. The teeth of feed dog 64 engage the work by rising above the surface of the needle plate.

In this way, one or two backward stitches, or one forward stitch, are produced, in accordance with the selected control segment 19, while program carrier 11 stands still.

Figure 5:
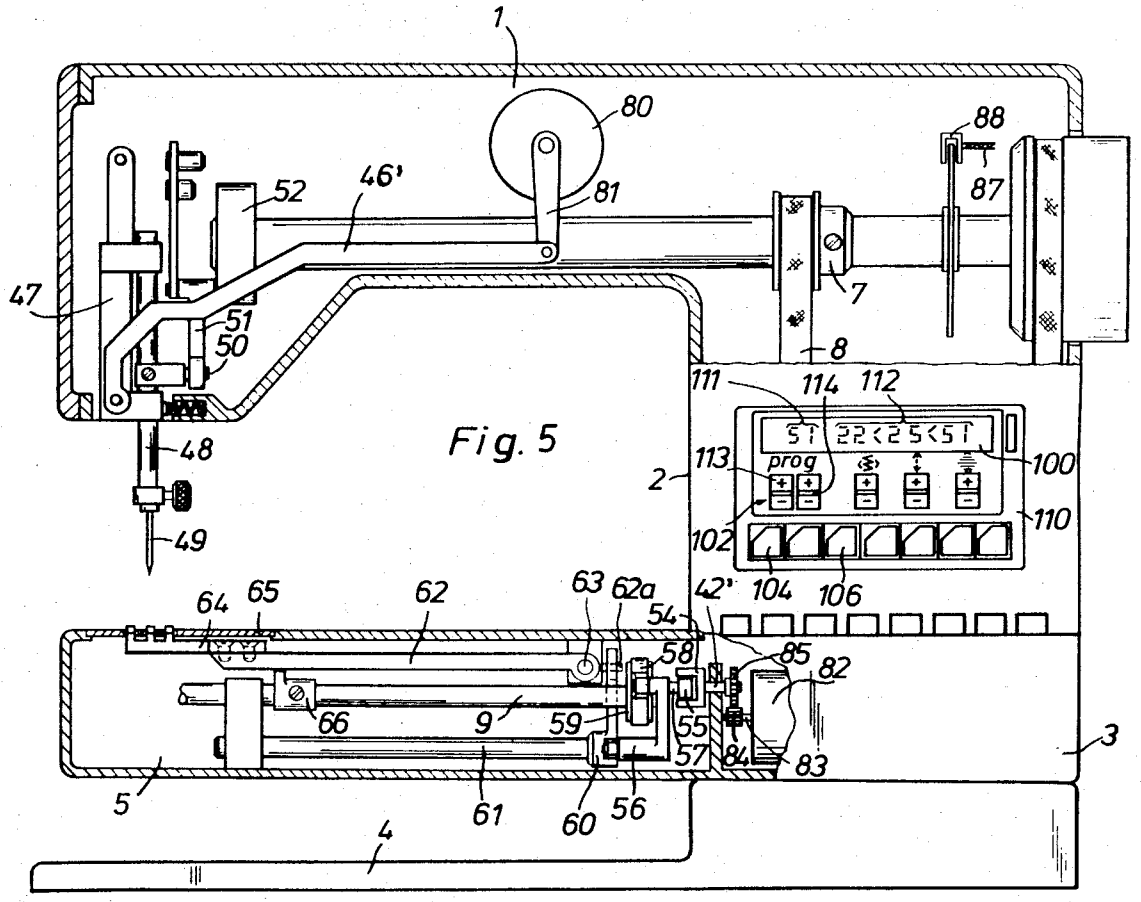
FIG. 5 is a view similar to FIG. 1 showing another embodiment of a sewing machine with an electronic control.
Figure 6:
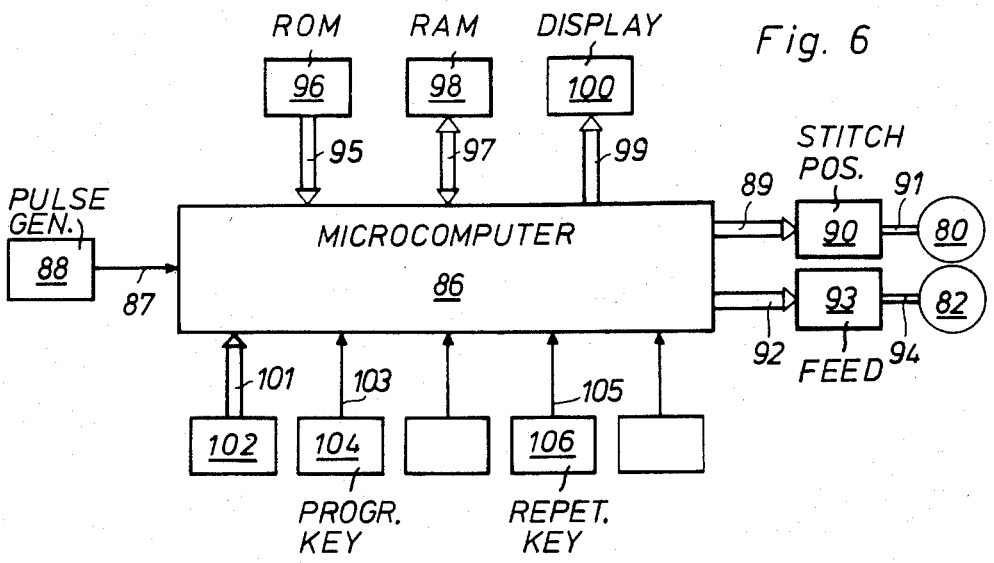
FIG. 6 is a block diagram of the control system of the electronically controlled sewing machine.
Figure 7A:
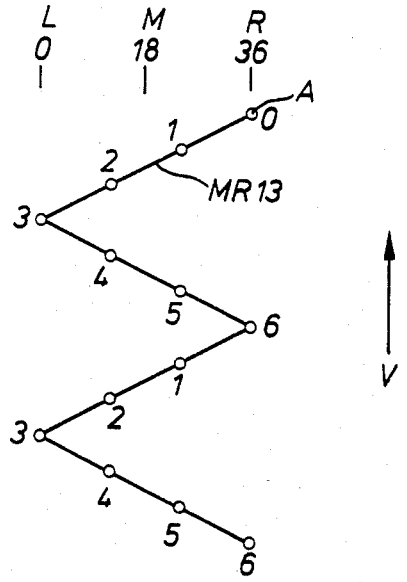
FIG. 7 shows on an enlarged scale the sequence of stitches during the production of a sewn pattern, and of modifications thereof, along with correponding tables of positioning through controlling stepping motors.
Figure 7B:
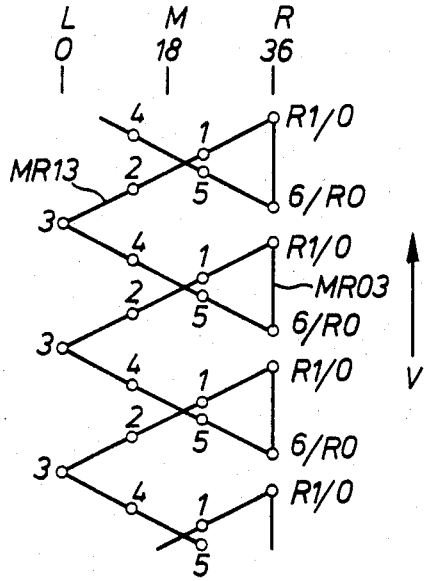
Figure 7C:
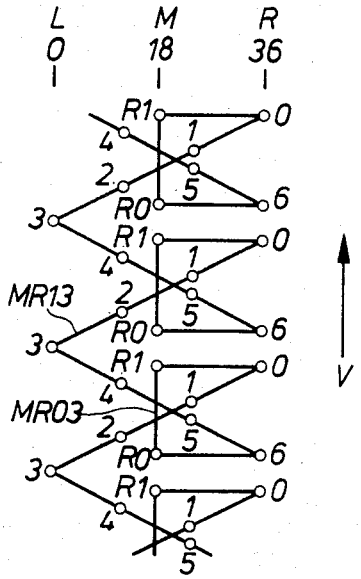
Figure 7D:
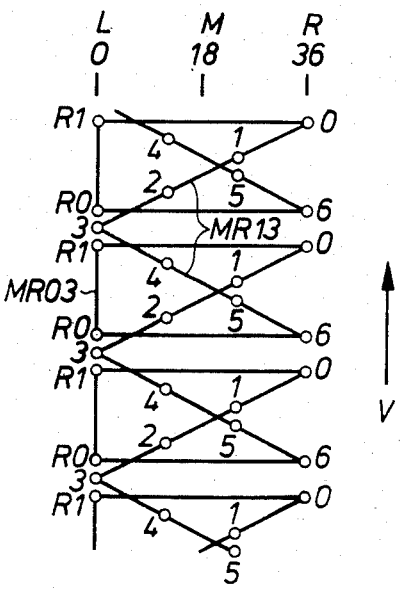

As soon as pulse generator 24 (FIG. 5) responds, flip-flop gate 71 is set again through closed contact 39*b*, and H potential is applied to input E2 of AND gate 69, and L potential to input E2 of AND gate 70. This interrupts the stepping pulses from pulse generator 68 to stepping motor 21, while the stepping pulses from pulse generator 67 through AND gate 69 to stepping motor 14 are transmitted. The new sewing pattern cycle starts.

FIGS. 4*a* to 4*d* illustrate the novel pattern combination produced by alternately controlling the two program carriers 11 and 18.

One pattern, whose sequence of stitches is produced in accordance with the information contained in a predetermined control segment 12 of program carrier 11, is shown in FIG. 4*a* and indicted at A. This pattern A may consecutively be repeated any number of times as desired. A combination of pattern A with a backward stitch B, as may be obtained by alternately driving program carrier 11 and 18, results in a pattern sequence shown in FIG. 4*b*. Another pattern sequence (FIG. 4*c*) is produced by combining pattern A with a stitch sequence C contained in program carrier 18 and comprising two backward stitches. Finally, FIG. 4*d* shows a pattern sequence where pattern A of program carrier 11 is combined with a single forward stitch D of program carrier 18.

Particularly by combining patterns comprising a series of stitches, alternately with one or more backward stitches, further configurations substantially differing in their aspect may be produced from known basic patterns.

In the embodiment illustrated in FIGS. 5–8, an electronic drive is substituted for the mechanical drive of the stitch position and feed of the sewing machine. For this purpose, arm 1 accommodates a stepping motor 80 which is connected through a crank 81 and a connecting rod 46' to the swing arm 47 of the needle bar. Within base 3, a stepping motor 82 is mounted driving through its shaft 83 and a pinion 84 a gear 85 which is secured to a setting shaft 42'. Secured to shaft 42' is guide member 54. The other parts of the mechanism and function of the stitch positioning and feed mechanism of the sewing machine corresponds to those of the embodiment of FIG. 1, so that no details or explanation are necessary.

Within the housing of the sewing machine, a microcomputer 86 is provided (FIG. 6), which is connected through lines 87 to a pulse generator 88 driven in synchronism by main shaft 1 of the sewing machine. At every revolution of the machine, pulse generator 88 delivers a pulse to microcomputer 86 as soon as needle 49 has emerged from the work and stepping motor 80 can change the position of the needle bar; a pulse is also delivered as soon as feed dog 64 has terminated its feed motion and stepping motor 82 can start with the control of the feed through another distance. Microcomputer 86 is connected through lines 89 to a device 90 for controlling the stitch position which in turn is connected through lines 91 to stepping motor 80. Through lines 92, microcomputer 86 is connected to a device 93 for controlling the feed which is further connected through lines 94 to stepping motor 82.

Microcomputer 86 is connected through lines 95 to a fixed storage (ROM) 96, through lines 97 to a working storage (RAM) 98, and through lines 99 to a display unit 100. Connected to microcomputer 86 in addition are a selection unit 102 through lines 101, a program entering key 104 through a line 103, and a repetition key 106 through a line 105.

The two stepping motors 80 and 82 are identical in design and are controlled substantially in the same way. Stepping motor 80 is intended for controlling the sideward oscillatory motion of swing arm 47, while stepping motor 82 is to control the feed motion of feed dog 64.

The design and function of the microprocessor control is generally known, wherefore a description is omitted. Details on the control of stepping motors through a microprocessor or microcomputer may be learned from German OS No. 29 42 844, for example.

To the front side of the housing of the sewing machine, a control panel 110 (FIG. 5) is secured. Within the panel, display unit 100 is mounted. this unit comprises a portion 111 with two display elements, and a portion 112 with 11 display elements. In portion 111, the sewing patterns to be recalled are indicated by a two-digit number.

Portion 111 is associated with two rocker-type buttons 113,114 forming the selector device 102. With the button 114 at the right, the two-digit number formed by the two display elements can be indexed up (+) or down (−). The button 113 at the left is provided for independently indexing the left display element up (+) or down (−).

Below rocker-type buttons 113 and 114, the program entering key 104 and the repetition key 106 are provided.

The display elements of display unit 100 are connected through lines 99 to microcomputer 86 by which they can be switched to a program storage formed by a portion of working storage 98.

The electronic control part of the sewing machine is so designed that the control instructions for stepping motors 80 and 82 of each individual sewing pattern are stored in coded form in the fixed storage 96 of microcomputer 86 as a control segment S, and that they can be transferred therefrom to be entered, by the pattern number and in a desired sequence, into the program storage section of working storage 98.

To select a certain combination of sewing patterns, the decadic number taken from a table and assigned to the first sewing pattern is set up in the display elements of portion 111 of display unit 100, by the two rocker-type buttons 130 and 114. Following this setting, immediately, the basic data corresponding to the selected sewing pattern are transferred from fixed storage 96 into the working storage 98. By actuating program entering key 104, the pattern number is entered into the program portion of working storage 98. In the same way, further sewing patterns may be recalled from fixed storage 96 and entered into the program storage by key 104. Sewing sequences combined of individual sewing patterns in any succession may thus be stored as a program.

With the program storage terminated, by actuating repetition key 106, the machine is switched to the mode "sewing of stored patterns" and simultaneously, the content of stored pattern numbers is displayed in portion 112 of display unit 100.

During the sewing operation, in a manner known per se, upon every recall of a pattern number by microcomputer 86, the coded control data of the respective sewing pattern contained in control segment S are recalled one after the other. Microcomputer 86 thus controls the sideward oscillatory motions of swing arm 47 through stitch position controlling device 90 and stepping motor 80 and the feed motions of feed dog 46 through feed control device 93 and stepping motor 82 in accordance with the programmed sequence which is then repeated.

At the start of a stitching operation, swing arm 47 is pivoted by stepping motor 80 through crank 81 and connecting rod 46' into the new stitching position for needle 49. Stepping motor 82 through pinion 84 and gear 85 adjusts the position of guide member 54. As bolt 57 is moved by eccentric rod 58, sliding block 55 is shifted back and forth in guide member 54. Through link 56, sliding block 55 causes pivoting of angle lever 60 in accordance with the angular position of guide member 54. Angle lever 60 shifts supporting arm 62 back and forth on shaft 63 thereby imparting translational movements to feed dog 64 which is secured to the free end of arm 62. The amount of this feed dog movements depends on the angular position of stepping motor 82.

In synchronism with its translational movement, feed dog 64 is also moved upwardly, by lifting eccentric 66 which is secured to shaft 9, so that the teeth of the feed dog are elevated above the surface of needle plate 65 and engage the work.

In a normal stitching adjustment, the step positions (FIG. 7) in which needle 49 forms a stitch, i.e. pierces the work, range from an initial position 0 (left-hand stitch position) to a position 36 (right-hand stitch position). The step positions of feed dog 64 during a stitch may vary from −18 to +18. These positions are indicated in a table associated with the respective sewing pattern, with the individual positions of the work being indicated in that table with a + sign if the movement is to be effected in the feed direction V and with a − sign if a movement in the opposite direction is involved.

The various sewing patterns differ from each other in the number of stitches and in the needle and feed positions for the individual stitches. However, the process of producing a sewn pattern in basically the same for any sewing pattern having its data stored in the fixed storage 98 of microcomputer 86. It will therefore be satisfactory to explain the process with reference to the example MR 13 shown in FIG. *7a*.

The sequence of stitches of sewing pattern MR 13 shown in FIG. *7a* may be learned from the associated table where the consecutively numbered piercing points of the needle and the corresponding feed and needle positions to be set by stepping motors 80 and 82 are listed. The pattern sewing operation starts at A, in the feed position 0 and with the needle 49 in its right-hand stitch position 36, at piercing point 0. Into this position, needle 49 is swung from its initial position 0 by stepping motor 80, while stepping motor 82 stands still. The next point 1 at which needle 49 pierces the work is given by the feed position +6 and needle position 24, i.e. stepping motor 82 (see also FIG. 5) executes a rotary motion in the respective direction and sets guide member 54 into a position such that feed dog 64 displaces the work by 6 unit steps in the feed direction (arrow V). At the same time, stepping motor 80 brings needle 49 into position 24.

The other stitches are made with needle 49 in the positions as indicated by the table. The elementary pattern MR 13 is thereby produced. This pattern may be repeated as many times as desired. If a single elementary pattern is sewn, seven stitches are made (piercing points 0 to 6). If the same elementary pattern is repeated, however, microcomputer 86 is properly programmed to omit piercing point 0 at the next repetition of elementary pattern, since in a sequence, the initial piercing point of the repeated series of stitches coincides with the last piercing point of the preceding one.

By combining elementary pattern MR 13 with a single backward stitch segment, new patterns are produced. For example, a combination of pattern MR 13 with a single backward stitch MR 03 provided in the right-hand position results in a pattern shown in FIG. *7b*, and with the backward stitch MR 03 in middle or left-hand position, the patterns *7c* and *7d* respectively are obtained. The respective piercing points are designated R0 and R1. Since both patterns MR 13 and MR 03 are individual patterns, the programs of both of them comprise piercing point 0. Prior to entering the individual patterns into the program storage, by means of key 103, both the standard length and the standard width of the pattern can be modified, so that not only the mutual position but also the size of the individual patterns in the combination may be varied.

Figures 8A, 8B, 8C, 8D:
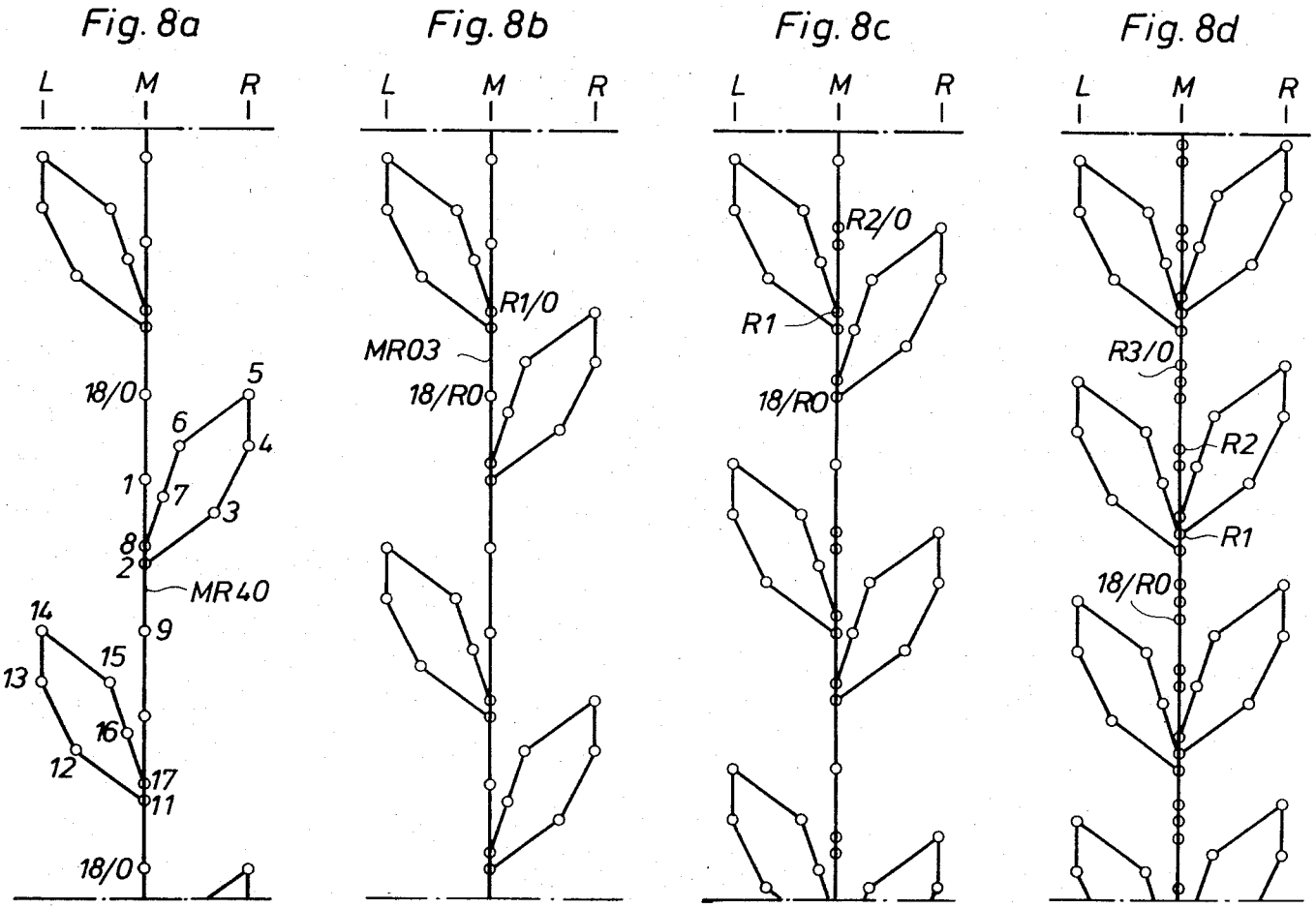
FIG. 8 shows another sewn pattern using in various combinations one or more backward stitches.

Sequences of a sewing pattern MR 40 may be sewed alone, as shown in FIG. 8*a*, or in a combination with one, two or three backward stitches MR 03 as shown in FIGS. 8*b, c, d* respectively. According to FIG. 8*a*, pattern MR 40 is sewed in its form as programmed. The consecutive piercing points 0 to 18 are indicated. In FIGS. 8*b, c, d* showing the combination of pattern MR 40 with backward stitches, for reasons of clarity only the piercing points of the backward stitches (R0, R2, R3) and the end points of the MR 40 pattern (0, 18) are indicated.

While specific embodiments of the invention have been shown and described in detail to illustrate the application of the principles of the invention, it will be understood that the invention may be embodied otherwise without departing from such principles.

What is claimed is:

1. In a sewing machine including a rotatable drive shaft driving a needle for vertical upward and downward movement in a swing arm which is connected to the shaft for selected pivotal swing movement through a selected needle bight distance during its vertical reciprocation, a feed dog which is movable selectively upwardly and downwardly and back and forth in a feed direction for engaging and moving a workpiece material in selected directions, a needle swing control for controlling the swing movement of said needle mounted on the sewing machine, and a workpiece feed control for controlling feed of the workpiece mounted on the sewing machine, the improvement comprising a bight program storage for storing information on needle swing to form a plurality of different predetermined multistitch patterns, a workpiece program storage for storing information on workpiece feed for forming the plurality of different predetermined multistitch patterns in conjunction with said bight program storage, selector means connected to said bight and workpiece program storages and to said needle swing and workpiece feed controls for selecting and sewing a sequence of said plurality of different patterns to be sewn in a forward direction, and backstitch generating means operatively connected to said workpiece feed control for selectively inserting at least one backstitch which is formed in a direction opposite to said forward direction between individual patterns of said sequence of patterns formed by said selector means whereby the sequence of patterns formed with said at least one backstitch between patterns appears different from a sequence of said patterns without at least one backstitch between patterns.

2. In a sewing machine according to claim 1, the improvement comprising said backstitch generating means comprising a further program storage for storing information on forming at least one backstitch and a selector switch for actuating said further program storage to insert at least one backstitch between patterns of said sequence.

3. In a sewing machine according to claim 1, the improvement comprising said bight and workpiece program storages comprising a fixed ROM storage for storing the information on needle swing and workpiece feed, the infomation including a starting and ending address for each of said plurality of different predetermined multistitch patterns, corresponding respectively to a starting and ending piercing position for said patterns, said selector means comprising a programable working RAM storage in which the starting address of patterns to be included in said sequence of patterns is stored, switch means for storing the starting addresses of the patterns in the selected sequence of patterns in the programable working storage, a microcomputer for sequentially reading out the sequence of patterns corresponding to the starting addresses of the patterns stored in the programmable working storage, said backstitch generating means comprising at least one storage location in said fixed ROM storage for containing information to form a single backstitch, said information to form a single backstitch including an address which can be stored in said programable working storage at least once, and a program entry button operably connected to said fixed and programable storages for selectively applying said address of the information for forming a single backstitch between patterns in said sequence of patterns.

4. A method of producing a sequence of predetermined multistitch sewing patterns in a forward direction using a sewing machine having a fixed storage for storing a plurality of different predetermined multistitch sewing patterns and means for selecting and sewing a sequence of patterns made up from said different sewing patterns, each of said different sewing patterns having a first piercing position and a last piercing position, the method comprising selecting a sequence of said different sewing patterns to be formed in said forward direction, forming a first pattern of said sequence up to the last piercing position of said first pattern, forming at least one backstitch starting at the last piercing position of the first pattern in a direction opposite to said forward direction, and thereafter forming a second pattern in said sequence of patterns starting with the first piercing position of said second pattern which corresponds to a last piercing position of at least one backstitch or, alternatively, sewing said sequence of patterns without said at least one backstitch whereby said sequence of patterns with said at least one backstitch has an appearance which is different from the sequence of patterns without said at least one backstitch.

5. A method according to claim 4, including inserting at least one backstitch between a last piercing position of each pattern in said sequence and a first piercing position of a following pattern in said sequence.

* * * * *